United States Patent [19]

Silverman et al.

[11] 4,371,171

[45] Feb. 1, 1983

[54] SELF-CONTAINED GAME

[75] Inventors: Gary S. Silverman, Plymouth; Robert D. Zera, Minneapolis; James F. Kubiatowicz, Fridley; Robert L. Claussen, Crystal, all of Minn.

[73] Assignee: Custom Concepts Incorporated, Minneapolis, Minn.

[21] Appl. No.: 214,044

[22] Filed: Dec. 8, 1980

[51] Int. Cl.[3] ..... A63F 9/02

[52] U.S. Cl. ..... 273/357; 273/399

[58] Field of Search ..... 273/357, 399, 355, 356

[56] References Cited

U.S. PATENT DOCUMENTS 2,203,990 6/1940 Heymer ..... 273/399 X 4,177,992 12/1979 Todokoro ..... 273/399 X 4,245,842 1/1981 Kuna et al. ..... 273/357

4,253,669 3/1981 Ferris et al. ..... 273/399 X

*Primary Examiner*—Anton O. Oechsle

*Attorney, Agent, or Firm*—William L. Huebsch

[57] ABSTRACT

A self-contained game providing an enclosed space between a base and a transparent dome, and including a plurality of freely movable objects within the space. A plurality of levers are pivotably mounted on the base and can be manually activated by players via portions of the levers accessible outside the dome so that a hammer portion of the lever will impact objects at sockets on a surface portion of the base, causing the objects to fly upwardly into the space in an attempt by the players to propel the objects into receptacles on the base. After the game is completed, the game can be inverted to return the objects from the receptacles to the surface portion of the base so that the game can be replayed.

4 Claims, 4 Drawing Figures

SELF-CONTAINED GAME

Field of the Invention

The present invention relates to games of the type in which players simultaneously compete to propel objects into receptacles.

SUMMARY OF THE INVENTION

The present invention provides a novel and entertaining game in which players simultaneously compete to propel objects into receptacles, which game is self-contained so that the objects cannot become separated or lost during or after use of the game, and yet allows the players to easily determine the number of objects in each receptacle.

According to the present invention there is provided a game intended to be played by two or more players, which game includes a base, an at least partially transparent dome mounted on the base to provide an enclosed space therebetween, and a plurality of freely movable generally spherical similarly sized objects, such as marbles, within the space. The base has sockets or openings, each adapted to receive one of the objects, and a portion of its upper surface is shaped so that the objects will be guided via gravity to the openings. Open-topped receptacles are provided on the base and a lever is pivotably mounted on the base adjacent each opening. The lever may be manually operated by a player to impart a force to an object in the opening, causing the object to fly upwardly into the space in an attempt by the player to propel the object into one of the receptacles.

The players can operate the levers until all of the objects are propelled into the receptacles, count the number of objects in each receptacle to determine a winner, and then invert the game so that the objects fall out of the receptacles and are guided by the inner surface of the dome to the upper surface portion of the base so that the game can be replayed.

Counting the items in the receptacles is facilitated in that each receptacle has a lower portion partially defined by inner and outer generally vertical walls spaced at a distance only slightly exceeding the diameter of the objects, and by side walls spaced a distance exceeding a multiple of that diameter. Objects that are propelled into the receptacle will be disposed generally vertically and side by side between the walls, and the outer wall is transparent so that the objects in the receptacle can be viewed and counted through the dome and outer wall.

BRIEF DESCRIPTION OF THE DRAWING

The present invention will be more thoroughly described with reference to the accompanying drawing in which like numbers refer to like parts in the several views and wherein.

DESCRIPTION OF THE PREFERRED EMBODIMENT

Figure 1:
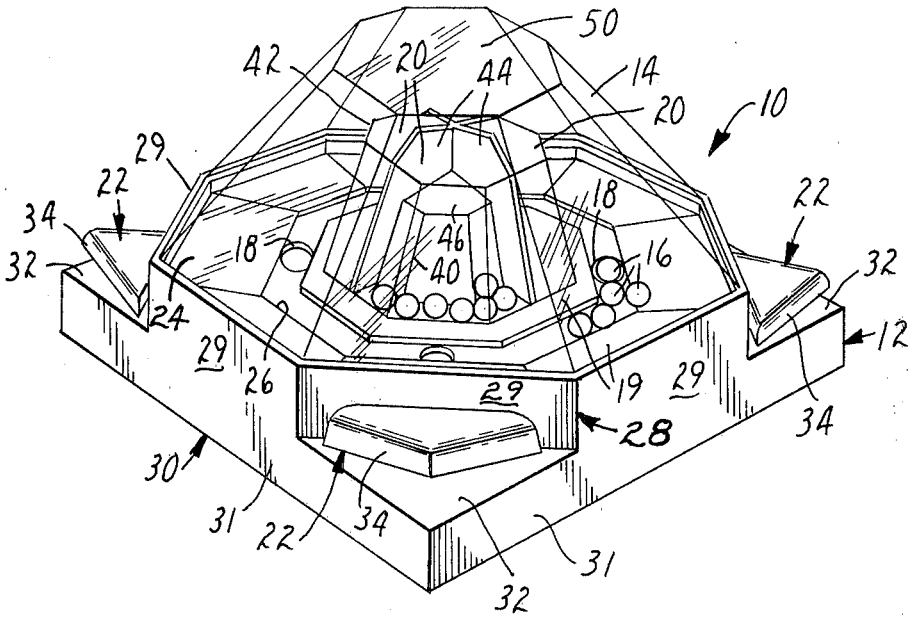
FIG. 1 is a perspective view of a self-contained game according to the present invention.
Figure 2:
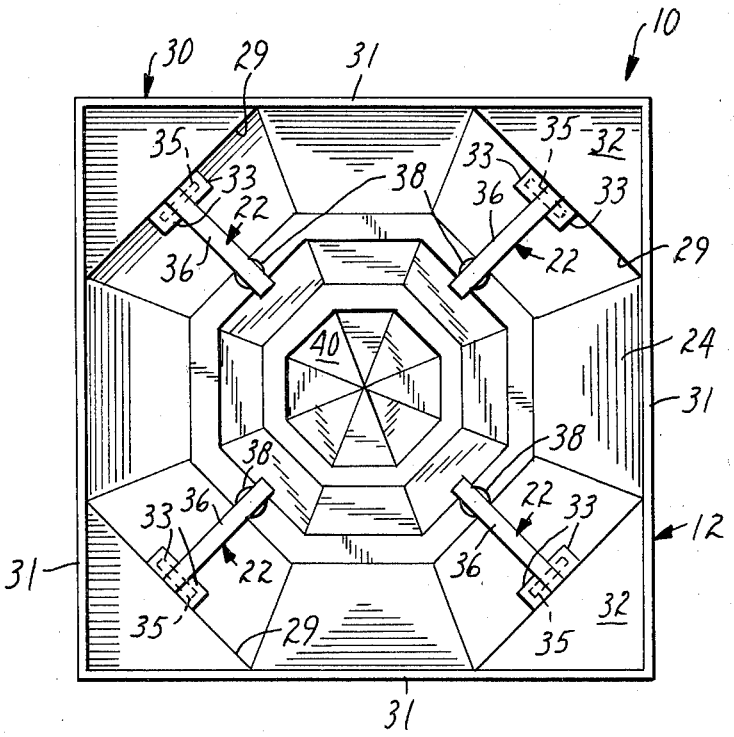
FIG. 2 is a bottom view of the game of FIG. 1.
Figure 3:
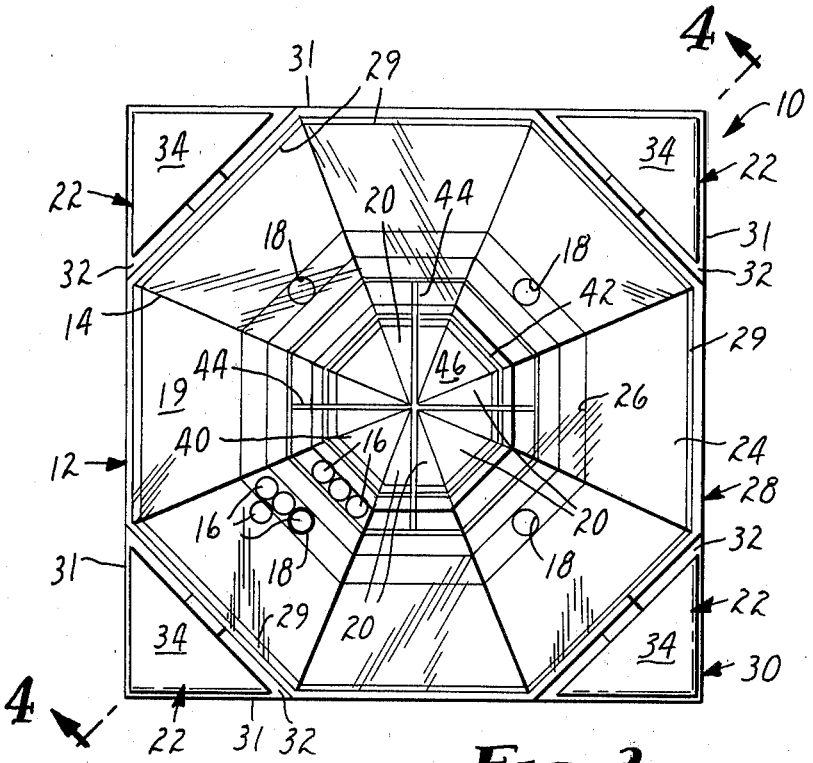
FIG. 3 is a top view of the game of FIG. 1.
Figure 4:
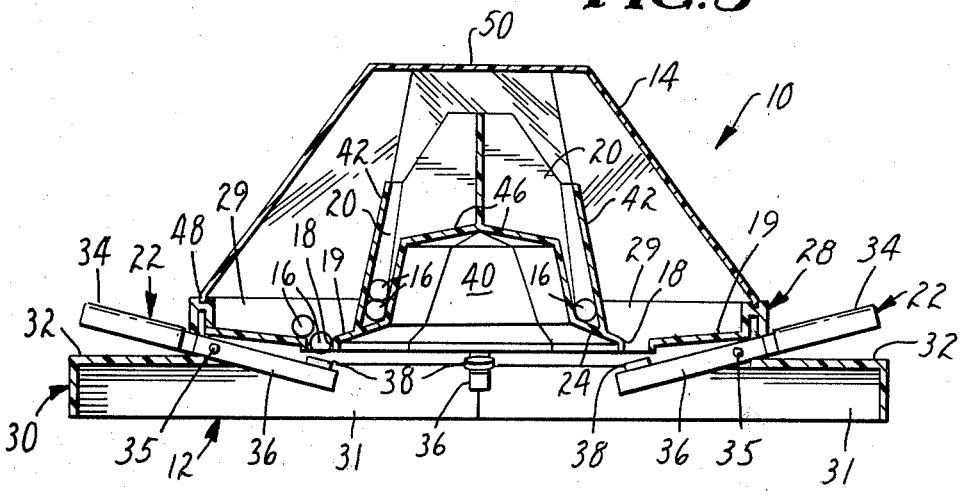
FIG. 4 is a sectional view taken approximately along line 5—5 of FIG. 3.

Referring now to the drawing there is shown a game according to the present invention generally designated by the numeral 10.

Generally the game 10 comprises a base 12, and an at least partially transparent dome 14 fixed on the base to provide an enclosed space therebetween. A plurality of freely movable objects 16 (such as marbles) are within the space. The base 12 has sockets or openings 18 each adapted to receive one of the objects 16 along an upper surface portion 19 of the base 12, and the upper surface portion 19 is shaped so that when it is uppermost with the base 12 supported right side up on a generally horizontal surface, the objects 16 will be biased via gravity toward the openings 18. A plurality of open-topped upstanding receptacles 20 are centrally located on the base 12, and the device 10 includes a lever 22 pivotably mounted on the base 12 for each opening 18. The lever 22 adjacent each opening 18 can be manually impacted to impart a force to an object 16 in the opening 18, thereby causing that object 16 to fly upwardly into the space between the base 12 and dome 14 in an attempt by a player to propel the object 16 into one of the receptacles 20.

The base 12 is a thin wall member formed as by injection molding of a polymeric material to provide (when the base is supported upright on a generally level surface) an octagonal top wall 24 providing the upper surface portion 19 which has parts inclined downwardly from its outer and inner periphery toward an octagonal track 26 having a width about the same as the width of the objects 16 extending around the receptacles 20, through which track 26 the openings 18 are formed. The track 26 is slightly inclined toward the openings 18 so that objects 16 on the upper surface portion 19 will move toward the track 26 and then move about the track 26 into the openings 18 via gravity and vibrations transmitted through the base 12 as the game 10 is played.

The base 12 also includes a vertical edge wall 28 having octagonally disposed sections 29 depending from and extending around the edge of the top wall 24, with every other one of its sections 29 merging with sections 31 of a depending rectangular peripheral wall 30 for the base 12. Horizontal triangular walls extend between every other section 29 of the octagonal edge wall 28 and the corners of the peripheral wall 30, and with the peripheral wall 30 provide four right triangular platforms 32.

Four of the levers 22 are provided, with each of the levers 22 being pivotably mounted through an opening in a different one of the sections 29 of the octagonal edge wall 28 adjacent the triangular platforms 32 via pivot blocks 33 mounted to the inner surfaces of that section 29 which receive outwardly projecting portions of a pin 35 pressed transversely through the lever 22 so that a generally triangular impact portion 34 of the lever 22 adapted to be manually struck is positioned on the upper side of the base 12 outside the dome 14 above the triangular platform 32, and an elongated hammer portion 36 of the lever 22 extends into a space beneath the top wall 24 of the base 12 so that a circular head 38 on the hammer portion 36 is positioned beneath the adjacent opening 18 in the track 26 which is centered in the track 26 along the section of the edge wall 28 through which the levers 22 extend. Each lever 22 is thus pivotably mounted on the base 12 for movement between a normal position (to which the lever 22 is biased by its weight distribution when the base 12 is right side up) with its triangular impact portion 34 tilted upwardly and spaced above the adjacent triangular platform 32, and the head 38 on its hammer portion 36 spaced below the adjacent opening 18; and an impact position at which its impact portion 34 is more closely adjacent the triangular platform 32 and its head 38 is in contact with the bottom surface of the top wall 24 around the opening 18 so that upon rapid movement of the lever 22 from its normal to its impact position, an object in the opening 18 will be impacted toward the receptacles 20.

The receptacles 20 are formed by a central upwardly-projecting truncated octagonal conical wall portion 40 of the top wall 24 having sections aligned generally parallel with the sections 29 of the edge wall 28, and an upwardly-projecting truncated octagonal conical open-topped clear plastic collar 42 attached at its bottom edge to the top wall 24 with its sections aligned parallel to and surrounding the sections of the conical wall portion 40, and spaced from the sections of the conical wall portion 40 by a dimension only slightly larger than the thickness dimension or diameter of the objects 16. Two transverse, normally-intersecting fins 44 project upwardly from an upper surface 46 of the conical wall portion 40 (which upper surface 40 is well recessed from the upper lip of the collar 42) and have portions extending between the opposed wall surfaces of the collar 42 and conical wall 40 to divide that space into four receptacles 20 of equal size. Portions of the fins 44 project above the upper edge of the collar 42 and serve as backstops to deflect objects 16 into upper portions of the receptacles 20 defined by the fins 44, a top surface 46 of the conical wall portion 40 and the collar 42, which upper portions have fairly large top openings in a plane generally parallel to the base 12. The top surface 46 of the conical wall portion 40 is slightly tapered so that once in one of the receptacles 20, the objects 16 will move via gravity to a lower portion of the receptacle 20 between the side of the conical wall portion 40 and the collar 42 where they will be disposed in side-by-side relationship so that they can be easily viewed and counted through the transparent dome 14 and transparent collar 42.

The dome 14 is an octagonal truncated conical transparent wall attached at its base in a mating groove 48 around the periphery of the top wall 24. The inner surface of the dome 14 serves as a deflection surface to direct objects 16 into the receptacles 20, and an uppermost wall 50 of the dome 14 is spaced from the top edge of the fins 44 so that when the game 10 is inverted, the objects 16 will fall out of the receptacles 20 into the dome 14, from whence they will move along the inner surface of the dome 14 back to the upper surface portion 19 of the top wall 24 as the game 10 is again turned right side up.

To play the game 10 (assuming all of the objects are initially positioned on the upper surface portion 19), up to four players each position themselves at one of the levers 22 and begin vigorously impacting its impact portion 34 to cause objects 16 in the adjacent openings 18 to fly into the space between the base 12 and dome 14 and hopefully into the adjacent receptacles 29. As objects 16 are thus propelled from the openings 18, other objects 18 positioned or landing on the upper surface portion 19 will move along its inclined parts and the track 26 into the openings 18, until all of the objects 16 are propelled into one of the receptacles 20. The game then being over, each of the players counts the number of objects 16 which will be disposed in side-by-side relationship in the lower portion of the adjacent receptacle 20 to determine a winner. The game 10 can then be inverted so that the objects 16 fall out of the receptacles 20 and move back onto the upper surface portion 19 as the game 10 is again positioned right side up so that the game 10 can be replayed.

The self-contained game according to the present invention has now been described with reference to one embodiment thereof. It will be appreciated by those skilled in the art that the game may be changed from the embodiment illustrated without departing from the spirit of the invention. For example, the sockets 18 could be depressions in the top wall 24, which top wall 24 could be sufficiently flexible so that the objects 16 could be propelled via the levers through the top wall 24. The objects other than marbles could be used, or the dome might not be entirely transparent, or many of the walls might be circular rather than octagonal. Thus the scope of the present invention should not be limited by the structure of the embodiment illustrated, but only by the structures described by the claims and their equivalents.

We claim:

1. A self-contained game comprising a base; an at least partially transparent dome mounted on the base to provide a single enclosed space therebetween; and a plurality of freely movable generally spherical similarly sized objects within the space; said space having a plurality of sockets opening into said single space, each adapted to receive one of the objects, and an upper surface having portions adjacent each socket shaped so that the objects will be guided via gravity to the adjacent socket; and said game further including open-topped receptacles generally centrally located on the base within said single space with a different one of said receptacles adjacent each of said sockets; and a plurality of levers each comprising an impact portion adapted to be impacted, and a hammer portion, each lever being pivotably mounted on said base with said impact portion accessible outside said dome and said hammer portion adjacent a different one of said sockets on the side of said base opposite said upper surface for pivotable movement from a normal position to which said hammer is biased with said hammer spaced from said socket, to an impact position with said hammer portion at said socket, so that said levers may be manually moved from their normal to their impact positions by players to impart force to objects in the sockets, causing the objects to fly upwardly into the space in an attempt by the players to propel the objects into the receptacles; said receptacles each including a lower portion defined by inner and outer generally vertical walls spaced at a distance only slightly exceeding the diameter of said objects and by side walls spaced a distance exceeding a multiple of said diameter so that objects in said receptacle will be disposed generally vertically and side by side between said walls, said outer wall being transparent to afford viewing and counting of said objects between said walls through said dome and outer wall.

2. A self-contained game according to claim 1 wherein said receptacles are centrally located on said base, with each of said receptacles having an upper portion communicating with said lower portion and being larger in area in a plane generally parallel to said base than said lower portion, said upper portion being defined by parts of said walls with the parts of said inner walls defining said upper portion projecting above the parts of said outer wall defining said upper portion.

3. A self-contained game according to claim 1 or claim 2 wherein said sockets are openings through said base, and said hammer portions are adapted to engage said objects in said openings when said levers are impacted.

4. A self-contained game according to claim 1 or claim 2 having four of said sockets and levers equally spaced around said base, and four receptacles centrally positioned on said base.

* * * * *